US009492001B2

(12) United States Patent
Luzon et al.

(10) Patent No.: US 9,492,001 B2
(45) Date of Patent: Nov. 15, 2016

(54) SYSTEM AND METHOD FOR TREATING A SURFACE

(75) Inventors: Josef Luzon, Bet Yeoshua (IL); Martin Gurovich, Tel Aviv (IL)

(73) Assignee: Derma Dream Group Ltd., Tortola (VG)

( * ) Notice: Subject to any disclaimer, the term of this patent is extended or adjusted under 35 U.S.C. 154(b) by 906 days.

(21) Appl. No.: 13/527,626

(22) Filed: Jun. 20, 2012

(65) Prior Publication Data

US 2013/0110032 A1 May 2, 2013

(51) Int. Cl.
*A61B 17/50* (2006.01)
*A45D 34/04* (2006.01)

(52) U.S. Cl.
CPC ..... *A45D 34/041* (2013.01); *A45D 2200/1018* (2013.01); *A45D 2200/1045* (2013.01); *A45D 2200/1054* (2013.01)

(58) Field of Classification Search
CPC ..... A45D 29/04–29/05; A45D 29/11–29/14; A45D 29/17; A61B 2017/320004–2017/320012; A61B 2017/00761; A61B 17/54–17/545; A61B 17/50; A61B 17/322
USPC ..... 606/131
See application file for complete search history.

(56) References Cited

U.S. PATENT DOCUMENTS 6,017,351 A 1/2000 Street
6,370,716 B1 * 4/2002 Wilkinson ..... 5/715
7,179,152 B1 * 2/2007 Rhoades ..... 451/41
2002/0045907 A1 * 4/2002 Sherman et al. ..... 606/131
2004/0254587 A1 * 12/2004 Park ..... 606/131
2006/0058714 A1 * 3/2006 Rhoades ..... 601/73
2006/0276731 A1 * 12/2006 Thiebaut et al. ..... 601/112
2007/0212965 A1 9/2007 Smith et al.
2008/0213321 A1 * 9/2008 Luzon ..... 424/400
2008/0235892 A1 * 10/2008 Williams ..... 15/210.1
2009/0062815 A1 * 3/2009 Karasiuk et al. ..... 606/131
2009/0277098 A1 * 11/2009 Spies ..... 51/295
2010/0051039 A1 3/2010 Ferrara
2011/0109019 A1 5/2011 Thiebaut
2013/0110032 A1 5/2013 Luzon et al.

FOREIGN PATENT DOCUMENTS

WO WO 2008/103896 8/2008

OTHER PUBLICATIONS

International Search Report for Application No. PCT/IL2013/050525, mailed on Oct. 13, 2013.

* cited by examiner

*Primary Examiner* — Victor Nguyen
*Assistant Examiner* — Jonathan Hollm
(74) *Attorney, Agent, or Firm* — Pearl Cohen Zedek Latzer Baratz LLP

(57) ABSTRACT

System and method for treating a surface are provided. A flexible or adaptable pad for treating a surface may be particularly suitable for treatment of uneven surfaces. An apparatus may include a mounting section and a flexible surface comprising a plurality of treatment sections. The treatment sections may comprise an abrasive material. Cracks or grooves on a surface of the apparatus enable a first and second treatment sections to assume a respective first and second positions with respect to a treated surface. An edge of a groove may be designed to increase an abrasiveness of the apparatus and may remove material from a treated surface. Other embodiments are described and claimed.

17 Claims, 4 Drawing Sheets

SYSTEM AND METHOD FOR TREATING A SURFACE

FIELD OF THE INVENTION

This application relates to a treatment of a surface. In particular, to a system, method and apparatus for polishing and/or exfoliating a surface.

BACKGROUND OF THE INVENTION

Various treatment systems and methods for treating skin, tissues or other surfaces are known. For example, cosmetic products, e.g., lotions, and various devices for treating skin are known. Devices including an electro-mechanical engine designed for linearly or otherwise moving an abrasive surface against a skin are also known in the art.

SUMMARY OF THE INVENTION

Embodiments of the present invention are directed to a flexible or adaptable pad for treating a surface, area or material. An apparatus and/or device according to embodiments of the invention may be particularly directed to a treatment of uneven surfaces. An apparatus for treating a surface may include a mounting section and a flexible surface comprising a plurality of treatment sections. The treatment sections may comprise an abrasive material and may be designed to maximize a contact area of the apparatus with a treated surface. In an embodiment, the apparatus may be manufactured from one or more flexible materials, e.g., silicon or rubber. Cracks or grooves on a surface of the apparatus may be provided such that a first and second treatment sections of a groove may be designed to increase an abrasiveness of the apparatus. Cracks or grooves on a surface of the apparatus may be designed to remove material from a treated surface. An apparatus may include holes or passages to enable passage of substance between an inner space of the apparatus and a space external to the apparatus.

An apparatus may include one or more internal supports designed to control a reaction of the apparatus to an external pressure. A portion of an internal space of an apparatus may be filled with a substance to control a reaction to external pressure. An apparatus may include a discharge unit for discharging material onto the treated surface. An apparatus may be mounted on a device using a mounting section and the device may translate one or more treatment sections with respect to a treated surface. Suction provided to an inner chamber of an apparatus to cause substance to flow from the chamber into a container. Flexibility of an apparatus may be controlled by controlling a pressure in an inner chamber of the apparatus and/or an amount of substance in an inner chamber of the apparatus. Temperature of the apparatus may be controlled.

BRIEF DESCRIPTION OF THE DRAWINGS

The subject matter regarded as the invention is particularly pointed out and distinctly claimed in the concluding portion of the specification. The invention, however, both as to organization and method of operation, together with features and advantages thereof, may best be understood by reference to the following detailed description when read with the accompanied drawings, in which like reference numerals indicate corresponding, analogous or similar elements, and in which:

DETAILED DESCRIPTION OF EMBODIMENTS OF THE INVENTION

Figure 1A:
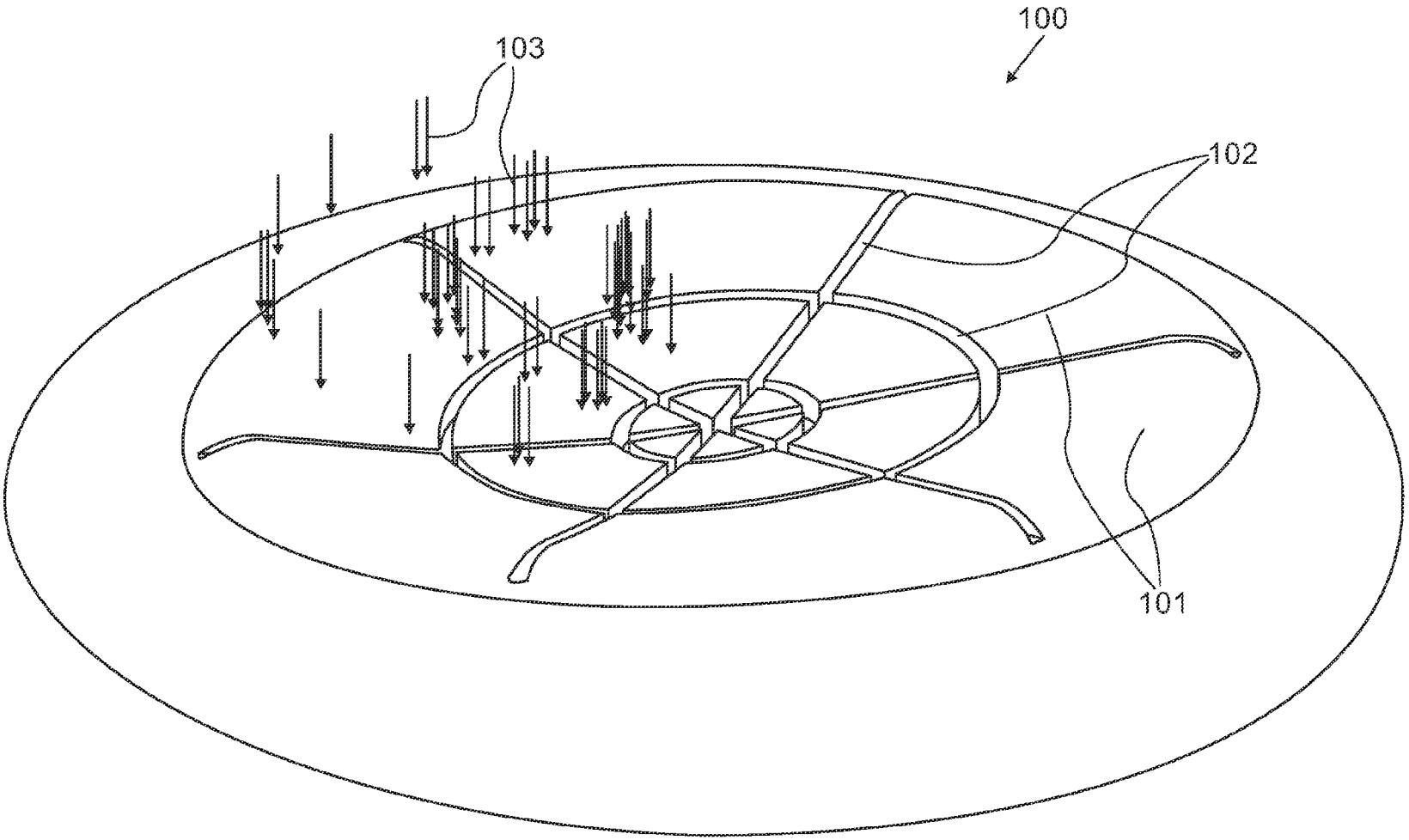
FIG. 1A, is a schematic illustration of a flexible pad according to embodiments of the invention.

In the following description, various embodiments of the invention will be described. For purposes of explanation, specific examples are set forth in order to provide a thorough understanding of at least one embodiment of the invention. However, it will also be apparent to one skilled in the art that other embodiments of the invention are not limited to the examples described herein. Furthermore, well-known features may be omitted or simplified in order to avoid obscuring embodiments of the invention described herein.

In the following detailed description, numerous specific details are set forth in order to provide a thorough understanding of the invention. However, it will be understood by those skilled in the art that the present invention may be practiced without these specific details. In other instances, well-known methods, procedures, and components, modules, units and/or circuits have not been described in detail so as not to obscure the invention.

Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. Unless explicitly stated, the method embodiments described herein are not constrained to a particular order or sequence. Additionally, some of the described method embodiments or elements thereof can occur or be performed simultaneously, at the same point in time, or concurrently.

Embodiments of the present invention provide a flexible or adaptable pad, which improves the superficial adaptation of such pad with a treated surface, area or material. An apparatus and/or device according to embodiments of the invention may be, or may include, a flexible pad for polishing, exfoliating, scrubbing, etc. As described, an apparatus and/or device according to embodiments of the invention may be particularly suitable for treating uneven surfaces, e.g., an uneven surface of a skin may be treated. Although the discussion herein mainly relates to treatment of skin, and, in particular, an uneven surface of a skin, it will be understood that treatment of other surfaces may be contemplated. For example, an apparatus and/or system according to embodiments of the invention may be used for polishing, exfoliation or otherwise treating possible uneven surfaces of metal, wood, stone, etc.

Embodiments of the invention include a flexible, pliable or malleable pad or membrane designed to provide extended surface adaptation to a treated area. As described herein, an apparatus may be used in cosmetic applications, such as mechanical skin exfoliation as well as in industrial and artistry applications for any uneven surface polishing. As described herein, a pad may have different flexibility and or deformation levels and/or different abrasive grades. Attributes of a pad (e.g., flexibility or an abrasive grade) may be determined at a production stage or they be dynamically controlled, altered or modified. An apparatus may be manufactured according to a number of predefined parameters. For example, an abrasive level, grade or rate, a flexibility, an elasticity and/or an adjustability to a treated surface may all be set. Other parameters used at a production stage may be a size, a shape and materials used.

According to some embodiments of the invention, an apparatus (e.g., a flexible pad) may be mounted on a device. For example, a flexible pad described herein may be installed on an electro-mechanical powered machine that may enable movement of the pad, e.g., rotating, vibrating, or linearly moving the pad. In other embodiments, a flexible pad may be manually operated. In some embodiments, parameters such as a flexibility, an elasticity and/or an adjustability to a treated surface may be set and/or altered dynamically and/or continuously, e.g., during operation of a system, e.g., a system comprising a pad mounted on an electro-mechanical powered device.

Reference is now made to FIG. 1A that shows a schematic illustration of a flexible pliable or malleable pad or membrane 100. As shown, pad 100 may include a plurality of treatment sections (or contact areas) 101 divided by cracks, cuts or grooves 102. As shown, an external force shown by arrows 103 may cause some of treatment sections 101 to yield while other treatment sections may remain in their original position. By producing a plurality of treatment sections 101 separated by cracks 102 as shown, an apparatus may maximize a contact area of the apparatus with a treated surface.

A treatment including scrubbing, polishing, peeling, exfoliation or similar operations may be achieved by implementing different grades of abrasiveness on treatment sections 101. Treatment sections 101 may be designed and produced in a variety of shapes in order to improve an adaptation to a treated surface. For example, treatment sections 101 may be in the form of concentric circles, pizza slices, or any other geometrical shape, including logos or artistic illustrations. Cracks 102 may be designed in order to extend usage of the apparatus. For example, some of cracks 102 may be located at specific areas that may be prone to tearing or breaking. For example, a concentric crack may be located along an edge of pad 100 where otherwise the pad may break, e.g., due to an inward folding of the center of pad 100.

Cracks 102 may be produced according to a number of parameters, for example, a width or depth. Pad 100 may be produced such that it has variable flexibility. For example, a first subset of cracks 102 may be produced according to a first set of parameters and a second subset of cracks 102 may be produced according to a second set of parameters. For example, cracks 102 closer to a center of pad 100 may be deeper or wider than cracks closer to the circumference or perimeter of pad 100 such that the center of pad 100 is more responsive to pressure than the perimeter. Other configurations producing other qualities of pad 100 may be contemplated. Alternatively or additionally, a first and second portions of pad 100 may be produced or manufactured to include a respective first and second materials or quantities. For example, the center of pad 100 may be made thicker than the perimeter such that a folding of pad 100 due to pressure is controlled. Accordingly, a gradient change in elasticity of pad 100, without visible boundaries, may be achieved. By controlling the shape assumed by pad 100 when pressure is applied, the aggregated contact area of treatment sections 101 with a treated surface may be extended or even maximized. Cracks 102 may enable a first and a second subsets of treatment sections 101 to assume a respective first and second orientations thus enabling pad 100 to adapt to a treated surface.

Cracks 102 may increase an abrasiveness of pad 100. For example, edges of at least some of cracks 102 may be formed as blades that may enhance a scrubbing or exfoliating effect of pad 100. Cracks 102 may be designed to remove material from a treated surface. For example, cracks 102 may be arranged such that when pad 100 is rotated, a centrifuge force causes dust, liquids or other substance collected in or by cracks 102 is translated outwards to an edge or perimeter of pad 100 thus removed from a treated area.

Treatment sections (or contact areas) 101 may be provided with different grades of abrasiveness and/or levels. Abrasiveness of contact area 101 may be achieved using a coating process to deposit materials such as sand, crystal, ceramic, diamonds and the like on pad 100. In some embodiments, an abrasive sticker may be glued or otherwise attached to pad 100 or to treatment sections 101. In other cases, abrasive material may be used during a production process, e.g., or by inserting an abrasive layer designed to be attached to the flexible pad 100 or by mixing abrasive substance into the material used for fabricating pad 100. In yet other embodiments, a first and a second subsets of contact areas 101 may be provided with a respective first and second abrasiveness grades or levels.

Figure 1B:
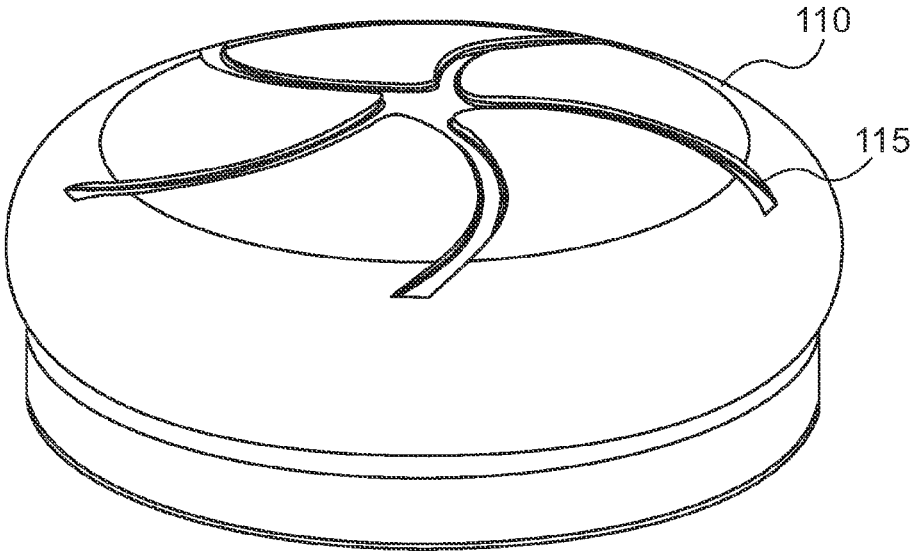
FIG. 1B, is a schematic illustration of a flexible pad according to embodiments of the invention.

Reference is now made to FIG. 1B that shows a schematic illustration of a flexible pliable or malleable pad or membrane 110. As shown, the cracks 115 on pad 110 are different from those on pad 100. For example, the cracks 115 shown on pad 110 may be designed such that they collect material scrubbed or otherwise removed from a treated surface. Cracks 115 may further be designed to remove substance from a treatment area. For example, a centrifugal force caused by a rotation of pad 110 may cause substance collected in cracks 115 to travel outwards to a perimeter of pad 110. Different designs of cracks (e.g., cracks 102 and 115) may provide respective different levels of adaptations. For example, the center of pad 110 may be more flexible than the center of pad 100 due to the different pattern or design of the cracks. Accordingly, an adaptation level may be determined by attributes of the cracks on a pad.

Cracks 102 may be designed to remove material from a treated surface. For example, cracks 102 may be arranged such that when pad 100 is rotated, a centrifuge force causes dust, liquids or other substance collected in or by cracks 102 is translated outwards to an edge or perimeter of pad 100 thus removed from a treated area.

Figure 1C:
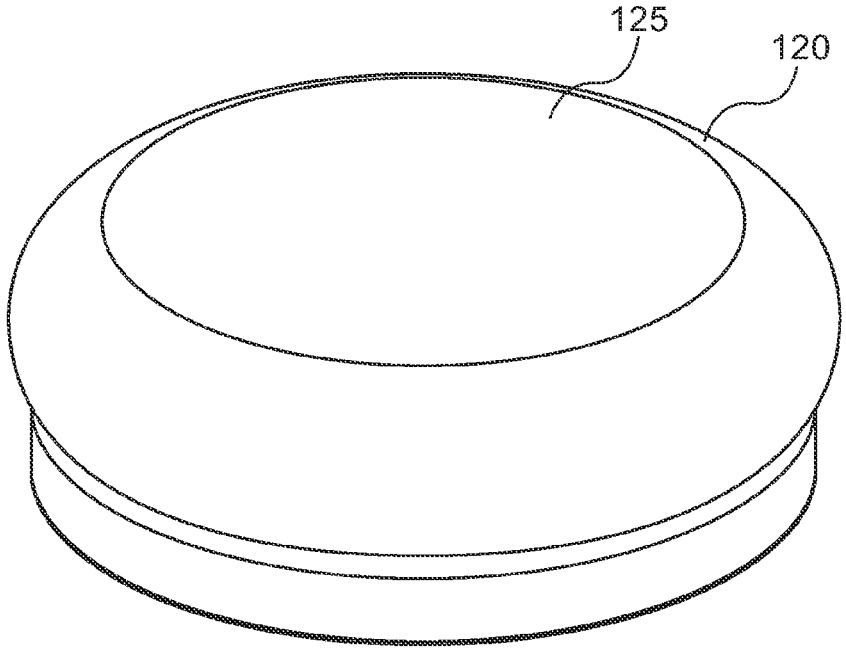
FIG. 1C, is a schematic illustration of a flexible pad according to embodiments of the invention.

Reference is now made to FIG. 1C that shows a schematic illustration of a flexible pliable or malleable pad or membrane 120. Pads 100, 110 and 120 may be designed such that they are suitable for various needs or tasks, e.g., polishing, scrubbing, exfoliating and the like. For example, different grades or levels of polishing or scrubbing may be achieved using different designs. Pad 120 is illustrates yet another design of a pad according to embodiments of the invention. Pad 120 may include a single treatment section 125. For example, pad 120 may be suitable for soft polishing. For example, treatment section 125 may be a soft and/or smooth surface. In an embodiment, treatment section 125 may be, or may include cotton fabric or a soft brush. Other coatings or surfaces may be used. For example, in an embodiment, the apparatus described herein may be used for hair removal. In such case, one or more treatment sections on a pad may be covered, coated or may otherwise include material or structure suited for hair removal. In yet other embodiments, a pad as described herein may be used for a massage.

For example, a pad may include a number of pressure points. For example, internal supports or ribs may produce one or more points on a surface of a pad that may act as moving pressure points when the pad is slowly moved or rotated on a skin or muscle. It will be understood that pads 100, 110 and 120 described herein are exemplary pads according to embodiments of the invention. Accordingly, a flexible pad may include one or more treatment sections that may be separated by any pattern of grooves or cracks as described herein. As described, a flexible pad may be manufactured using any combination of flexible and abrasive materials such that different abrasive levels or grades may be applied by a pad in operation. For example, the force (or abrasiveness) applied to a treated surface by a center of a pad may be greater than the force or abrasiveness applied by a perimeter of the pad. Accordingly, a pad according to embodiments of the invention may be specifically suitable for treating uneven surfaces. In particular, embodiments of the invention may be applicable for treating uneven surface of a human skin.

In an embodiment, the flexibility, thickness or other attributes of a pad or treatment section may not be constant, e.g., a flexibility or thickness may be different in different regions of the treatment section. For example, treatment section 125 may be provided or manufactured such the thickness of material is gradually reduced along an imaginary line from the perimeter towards the center of treatment section 125. Accordingly, the center of treatment section 125 may be more adaptive to a surface than the perimeter. Other designs may be contemplated, for example, in order to achieve variable adaptation, a perimeter of a pad may be manufactured from a first substance and a center of a pad may be manufactured from a second substance such that different treatment regions or sections may have respective different qualities, e.g., a flexibility of a first treatment section may be different than that of a second treatment section on the same pad.

Figure 2:
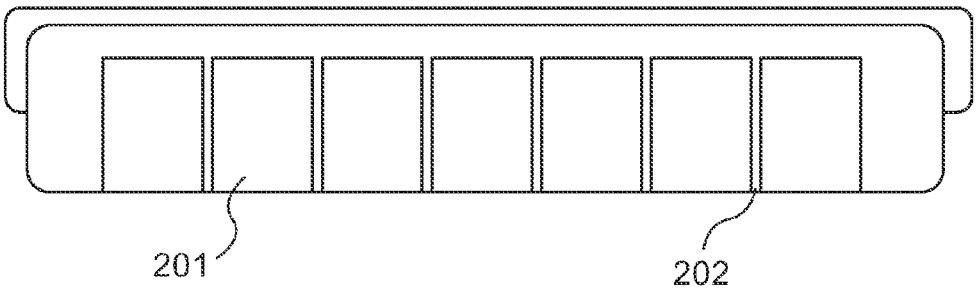
FIG. 2, is a schematic cross section of an apparatus according to embodiments of the invention.

Reference is now made to FIG. 2 that shows a schematic cross section of an apparatus according to embodiments of the invention. As shown, an apparatus may include supports 202 and chambers 201. For example, pad 100 may be constructed with supports and chambers as respectively shown by 202 and 201. Supports 202 may be designed, located and/or arranged such that a flexibility or pliability of pad 100 is controlled. Supports 202 may be designed, located and/or arranged such control a reaction of a treatment sections 101 to an external pressure is achieved. For example, a first subset of supports 202 may be thicker than a second subset or a density of supports 202 in a first region may be different than the density in a second region. Chambers 201 may be filled with air, gas, grains, cotton wool, liquids or a pseudo-solid body such as foam or silicon. Accordingly, a response of pad 100 to pressure and, consequently, adaptation to a treated surface, may be determined and/or controlled. A combination of supports 202 and gas or other substance in chambers or cavities 201 may enable extended flexibility control for pad 100. For example, any substance, e.g., gas or liquid may be directed into one or more chambers within a pad (e.g., pads 100, 110 and 120 described herein) such that a flexibility of a pad may be controlled and dynamically varied, e.g., by controlling an amount of substance in an inner chamber of a pad or apparatus.

Figure 3:
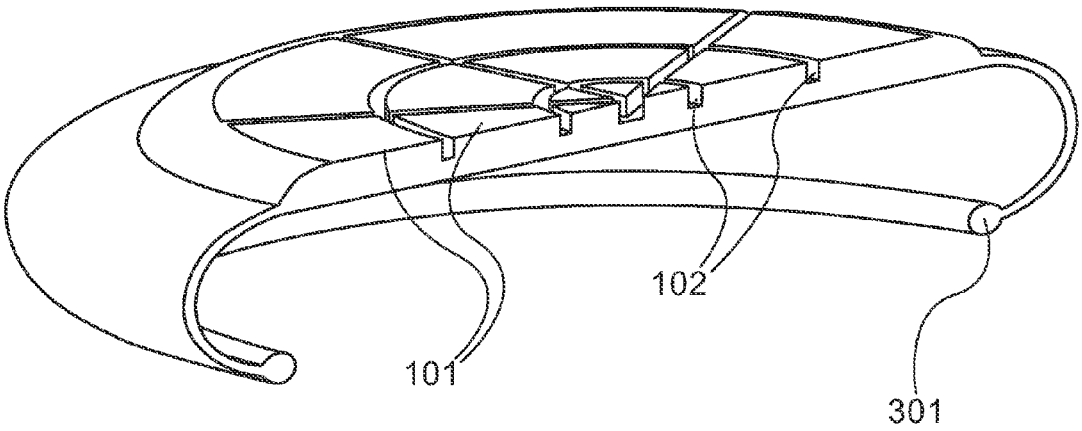
FIG. 3, is a schematic cross section of a flexible pad according to embodiments of the invention.

Reference is now made to FIG. 3 that shows a schematic cross section pad 100 according to embodiments of the invention. As shown by 301, pad 100 may include a mounting section. Mounting section 301 may be used in order to mount pad 100 on a handle or other construct that may be held by a user, e.g., when manually operating pad 100. Mounting section 301 may be used in order to mount pad 100 on a device, e.g., an electro-mechanical powered machine or device.

A method of treating a surface according to embodiments of the invention may include providing an apparatus that comprises a mounting section and one or more treatment sections, wherein the treatment sections are designed to maximize a contact area of the apparatus with a treated surface. A method of treating an uneven surface of a skin may include translating, with respect to a treated uneven surface of a skin, a flexible surface comprising a plurality of treatment sections, the treatment sections comprising an abrasive material. Cracks between the treatment sections may enable a first and second treatment sections to assume a respective first and second positions with respect to an uneven surface of a skin.

A method may further include translating the apparatus with respect to a treated surface. For example, the apparatus may be a pad as described herein and translating the pad may be by a specifically designed device. In an exemplary method, a pad as described herein (e.g., with respect to FIGS. 1A, 1B and 1C) may be rotated by a device as described herein, e.g., with reference to FIG. 4 below. A method of treating a surface such as human or other skin may include automatically and/or dynamically removing material from a treated surface, controlling reaction of an apparatus to external pressure by automatically filling a chamber of an apparatus with substance, controlling a pressure in an inner chamber of the apparatus and controlling temperature of the apparatus. A method of treating a surface such as human or other skin may include automatically and/or dynamically discharging material onto a treated surface and/or collecting substance from a treated surface into a container. For example, the methods discussed herein may be performed by a device as described with reference to FIG. 4.

Figure 4:
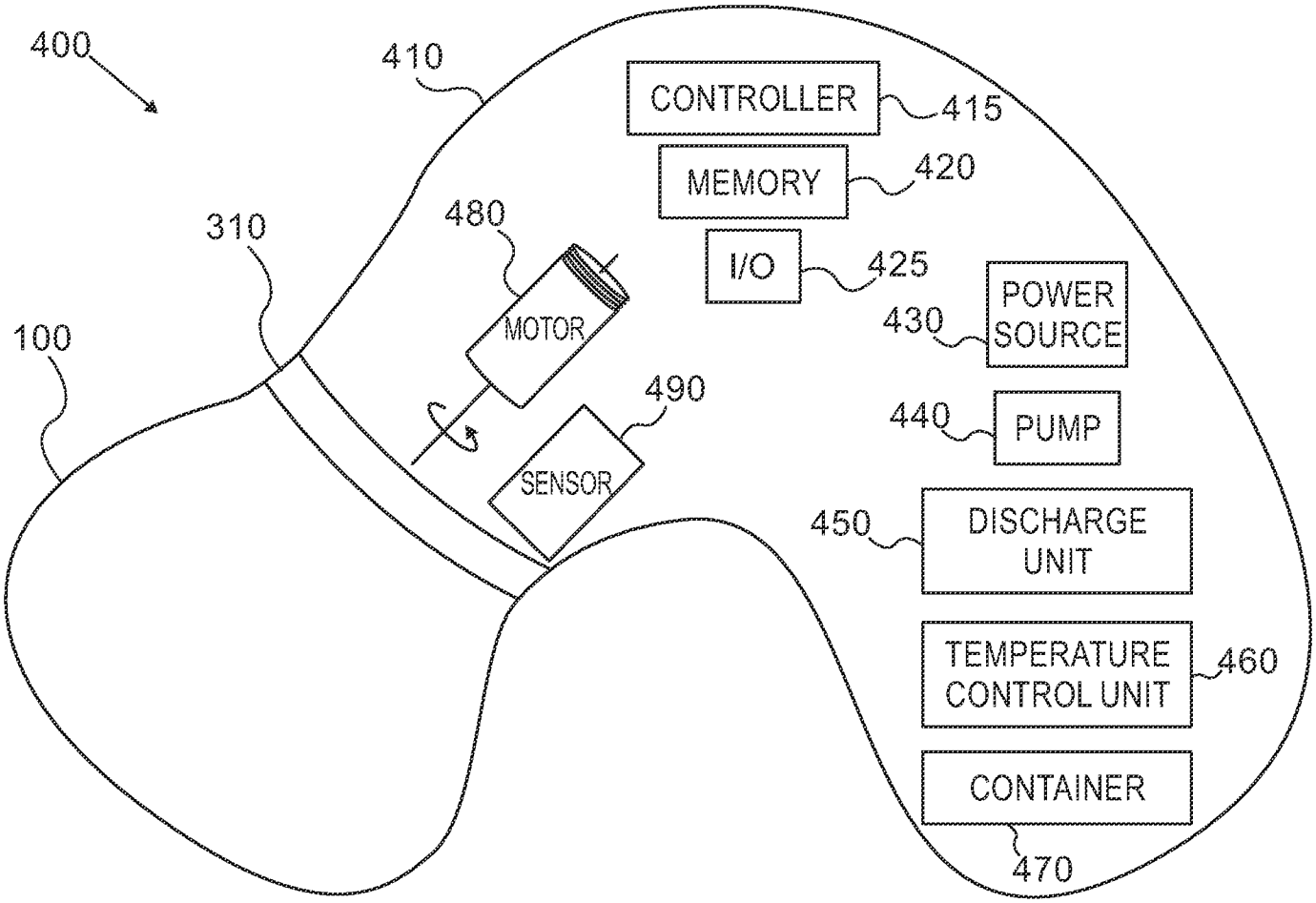
FIG. 4, shows a system according to embodiments of the invention.

Reference is now made to FIG. 4 that shows a system 400 according to embodiments of the invention. System 400 may be used for operations such as polishing, exfoliating, or scrubbing of uneven surfaces, e.g., a human skin. As shown, using mounting section 310, pad 100 may be mounted on, or attached to, device 410. Device 410 may translate pad 100 and treatment sections thereon with respect to a treated surface. For example, device 410 may rotate pad 100 and/or cyclically move pad 100 horizontally, linearly or otherwise such that treatment sections 101 on pad 100 scrub, polish or otherwise treat a surface. For the sake of clarity, wires, ducts and the like were omitted from FIG. 4. However, it will be understood that any means required in order to enable controller 415 to control components of system 400 may be produced. Likewise, although not shown, wires pipes, ducts and the like, e.g., to enable discharge unit to provide a substance to pad 100 or provide electric power to any of the components may be provided.

As further shown, device 410 may include a motor 480, a sensor 490, a controller 415, a memory 420 and an input/output component 425. Device 410 may include a power source (e.g., batteries) 430, a pump 440, a discharge unit 450, a temperature control unit 460, and a container 470. Controller 415 may control any operational aspect of system 400. Memory 420 may store various parameters, e.g., configuration parameters that may be used in a treatment. For example, a duration or cycle, speed of rotation, temperature, discharge of material or pressure inside pad 100 may all be controlled by controller 415 possibly based on configuration parameters stored in memory 420. Input/Output (I/O) system 425 may include any human interface, e.g., buttons and displays enabling a user to operate and configure system 400. For example, parameters stored in memory 420 may be altered or set by a user.

Motor 480 may be controlled by controller 415 and may rotate pad 100 e.g., by rotating a mounting plate (not shown) attached to pad 100 using mounting section 310. Sensor 490 may be any suitable sensor. For example, sensor 490 may sense or monitor a temperature, a pressure and the like. Sensor 490 may provide controller 415 with any sensed parameter. Accordingly, controller 415 may dynamically adapt an operation of system 400 based on dynamically monitored parameters. For example, controller 420 may cause motor 480 to reduce a speed of rotation of pad 100 if the temperature sensed by sensor 490 exceeds a threshold. Pump 440 may maintain a predefined pressure in a chamber or space inside pad 100 thus control an elasticity of pad 100. Based on a pressure sensed by sensor 490 controller 415 may activate or deactivate pump 440 such that a pressure (e.g., as stored in memory 420) is maintained within pad 100. To further control pressure, pad 100 may include holes or orifices such that pressure inside pad 100 may be released. Accordingly, in an embodiment, when pump 440 is idle, pressure inside pad 100 may rapidly decrease.

Discharge unit may enable providing a substance (e.g., an ointment or lotion) during a treatment. For example, discharge unit 450 may be connected (e.g., using small tubes) to openings, holes or orifices in pad 100 and may, based on an instruction or command from controller 415, discharge any substance through such openings. Pump 440 may introduce suction, vacuum or negative pressure to an inner space or chamber of pad 100. Accordingly, substance such as dust or material released from a treated skin may be sucked through openings in pad 100 and may further be translated to container 470. Container 470 may collect any discharged material. Temperature control unit 460 may enable cooling or heating pad 100. For example, cold or hot air may be provided by temperature control unit 460. For example, sensor 480 may inform controller 415 that the temperature of pad 100 is above a threshold. In such case, controller 415 may cause temperature control unit 460 to provide cold air into a chamber of pad 100. Similarly, hot air may be provided, e.g., for a treatment that requires a specific temperature.

Although discharge unit 450 is shown included in device 410 other configurations are possible. For example, a discharge unit 450 or cartridge may be included in pad 100. Discharge of substance from a discharge unit may be automatic (e.g., controlled by controller 415) or it may be manually controlled. For example, a user may cause a discharge unit incorporated in a pad 100 to release a lotion by pressing or quizzing the discharge unit. In other embodiments, a discharge unit incorporated in a pad 100 may autonomously discharge material, e.g., by an internal pressure in the discharge unit and via dedicated tubes, openings or orifices designed to carry substance from a discharge unit to an external surface of pad 100.

While the invention has been described with respect to a limited number of embodiments, it will be appreciated by persons skilled in the art that the present invention is not limited by what has been particularly shown and described herein. Rather the scope of the present invention includes both combinations and sub-combinations of the various features described herein, as well as variations and modifications which would occur to persons skilled in the art upon reading the specification and which are not in the prior art. While certain features of the invention have been illustrated and described herein, many modifications, substitutions, changes, and equivalents may occur to those skilled in the art. It is, therefore, to be understood that the appended claims are intended to cover all such modifications and changes as fall within the true spirit of the invention.

What is claimed is:

1. An apparatus for treating an uneven surface, the apparatus comprising:

a mounting section to mount the apparatus on a device; and a pad with a flexible surface comprising one or a plurality of treatment sections, the pad including one or a plurality of chambers, each provided with a plurality of supports, said one or a plurality of chambers and said plurality of supports to control flexibility of the flexible surface and enable the flexible surface to adapt to the uneven surface, a fluid substance being directable into one or more of said one or a plurality of chambers to dynamically control the flexibility of the flexible surface; and a device to which the pad is mounted using the mounting section, the device configured to rotate the pad.

2. The apparatus of claim 1, wherein the apparatus comprises a flexible material.

3. The apparatus of claim 1, wherein a crack enables a first and second treatment sections to assume a respective first and second positions.

4. The apparatus of claim 3, wherein a sharp edge of the crack is designed to increase an abrasiveness of the apparatus.

5. The apparatus of claim 3, wherein the crack is designed to remove material from the treated uneven surface.

6. The apparatus of claim 1, wherein the treatment sections comprise an abrasive material.

7. The apparatus of claim 1, comprising holes for passage of substance between an inner space of the apparatus and a space external to the apparatus.

8. The apparatus of claim 1, comprising a discharge unit for discharging material onto the treated uneven surface.

9. The apparatus of claim 1, wherein the device is configured to translate the treatment sections with respect to the treated uneven surface.

10. The apparatus of claim 1, wherein suction provided to the chamber of the apparatus causes substance to flow from the chamber into a container.

11. The apparatus of claim 1, wherein the device is configured to control a flexibility of the apparatus by controlling a pressure in the chamber of the apparatus.

12. The apparatus of claim 1, wherein the device is configured to control a temperature of the apparatus.

13. The apparatus of claim 1, wherein the device is configured to control a flexibility of the apparatus by controlling an amount of the substance in the chamber of the apparatus.

14. An apparatus for treating an uneven surface of a skin, the apparatus comprising:

a pad with a flexible surface comprising one or a plurality of treatment sections, the treatment sections comprising an abrasive material, the pad including one or a plurality of chambers, each being fillable with a fluid substance, a plurality of supports being arranged within said one or a plurality of chambers, said one or a plurality of chambers and said plurality of supports to control flexibility of the flexible surface and enable the flexible surface to adapt to the uneven surface of the skin, a fluid substance being directable into one or more of said one or a plurality of chambers to dynamically control the flexibility of the flexible surface; and a device to which the pad is mounted, the device configured to rotate the pad.

15. The apparatus of claim 14, wherein the wherein the flexible surface includes cracks between a plurality of the treatment sections, and wherein the cracks are designed to remove material from the treated uneven surface and wherein a sharp edge of a crack is designed to increase an abrasiveness of the apparatus.

16. The apparatus of claim 14, wherein the device is configured to:

control a pressure in the chamber of the apparatus;

control a temperature of the apparatus; and control a flow of substance from the chamber of the apparatus.

17. A method of treating an uneven surface of a skin, the method comprising:

translating with respect to a treated uneven surface of a skin a pad with a flexible surface comprising one or a plurality of treatment sections, the treatment sections comprising an abrasive material, the pad including one or a plurality of chambers, each being-fillable with a fluid substance, a plurality of supports being arranged within said one or a plurality of chambers, said one or a plurality of chambers and the supports to control flexibility of the flexible surface and enable the flexible surface to adapt to the uneven surface of the skin:

directing the fluid substance into one or more of said one or a plurality of chambers to dynamically control the flexibility of the flexible surface; and rotating the pad.

* * * * *